United States Patent [19]

Stock et al.

[11] 3,994,626

[45] Nov. 30, 1976

[54] PUMP APPARATUS

[75] Inventors: Arthur J. Stock, Lakewood; Donald E. Christofer, Willowick; Joseph E. Brinza, Euclid, all of Ohio

[73] Assignee: Stock Equipment Company, Cleveland, Ohio

[22] Filed: Oct. 25, 1973

[21] Appl. No.: 409,583

Related U.S. Application Data

[62] Division of Ser. No. 182,088, Sept. 20, 1971, Pat. No. 3,835,617.

[52] U.S. Cl. ..... 417/315; 417/454; 417/430; 417/507; 92/86.5

[51] Int. Cl.[2] ..... F04B 39/08; F04B 39/14

[58] Field of Search ..... 92/83, 86.5; 277/71; 417/315, 454, 507, 360, 900

[56] References Cited

UNITED STATES PATENTS

| | | | |
|---|---|---|---|
| 687,070 | 11/1901 | Schmidt | 417/510 |
| 970,927 | 9/1910 | Jones | 417/442 |
| 1,027,947 | 5/1912 | Wedge | 92/83 |
| 1,056,696 | 3/1913 | Laidley | 417/315 |
| 1,982,264 | 11/1934 | Naab | 417/315 |
| 2,018,144 | 10/1935 | Mesinger | 417/491 |
| 2,330,781 | 9/1943 | Languybr et al. | 417/900 |
| 2,485,208 | 10/1949 | Longenecker | 417/430 |
| 2,708,126 | 5/1955 | McLachlin et al. | 277/71 |
| 2,843,050 | 7/1958 | Harper | 417/507 |
| 3,104,619 | 9/1963 | Swarthout | 417/900 |
| 3,146,940 | 1/1964 | Mc Croy et al. | 417/364 |
| 3,261,611 | 7/1966 | Maidment | 277/71 |
| 3,327,641 | 6/1967 | Klasterman | 417/507 |
| 3,332,435 | 7/1967 | Anderson et al. | 417/315 |
| 3,422,766 | 1/1969 | Coninbeer | 417/360 |
| 3,520,640 | 7/1970 | Yampolsky et al. | 417/360 |
| 3,625,639 | 12/1971 | Eggman | 417/360 |

FOREIGN PATENTS OR APPLICATIONS

| | | | |
|---|---|---|---|
| 913,362 | 12/1962 | United Kingdom | 417/510 |

*Primary Examiner*—William L. Freeh
*Attorney, Agent, or Firm*—Bosworth, Sessions & McCoy

[57] ABSTRACT

Systems, apparatus and methods are disclosed for disposing of radioactive waste materials by placing them into a container such as a steel drum, together with cement or other solidifying agent and water or other suitable liquid in amounts sufficient to provide eventually a solidified mixture of predetermined amounts of cement or other solidifying agent and radioactive material, closing the drum, mixing the contents, and then storing the drum for a period of time. Also disclosed is a unique metering pump for delivering the radioactive dispersion to the drums in accurately measured quantities while preventing leakage from the radioactive side. The pump is mounted on a metal shield wall so that pump and valve parts can be removed for repair or maintenance from the safe side of the wall. The valves are independently operated by remote control to permit reverse operation for back flushing and flushing of the lines with clean water.

10 Claims, 9 Drawing Figures

243
330
338
339e
339
215
231
244
344
345
345e
242
243e
226
228
229
451
461
457
214
452
453

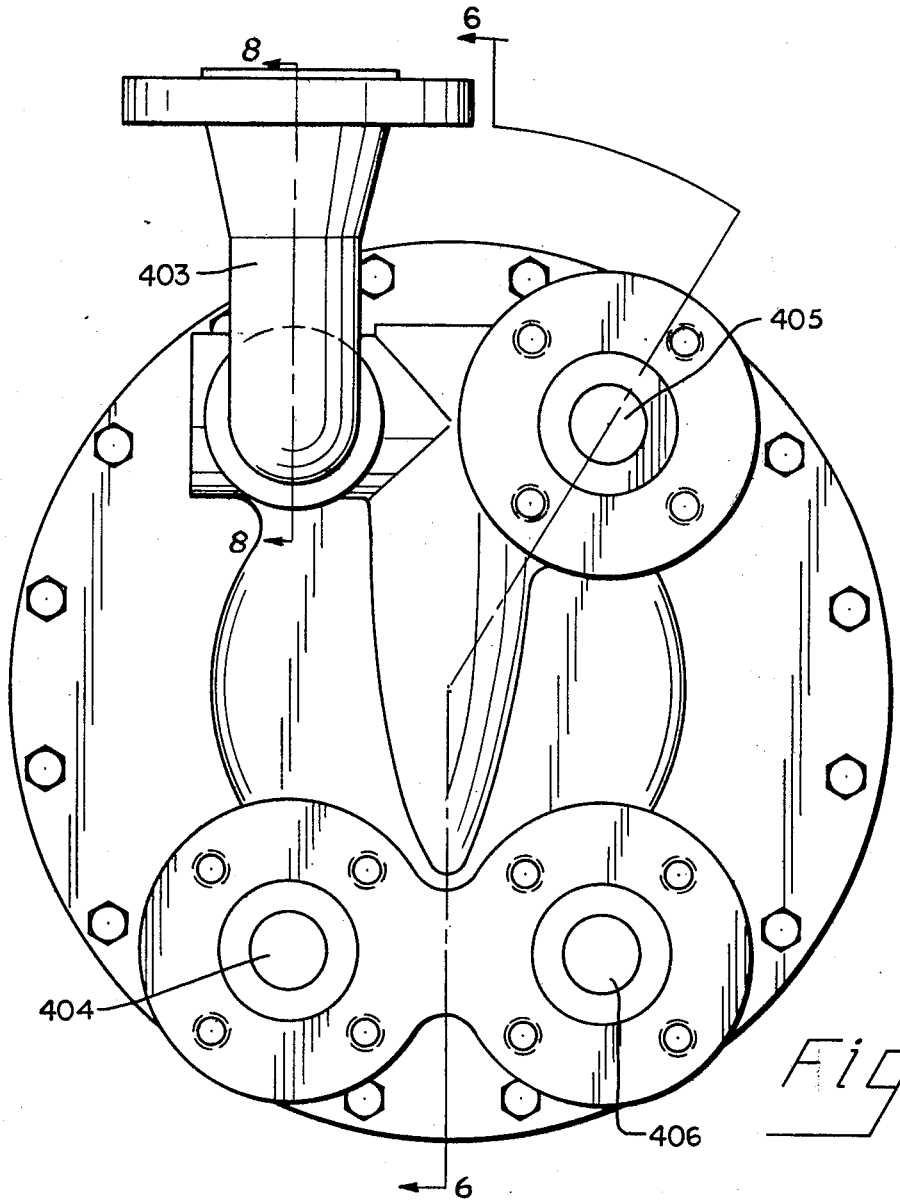
Fig. 7
Fig. 8
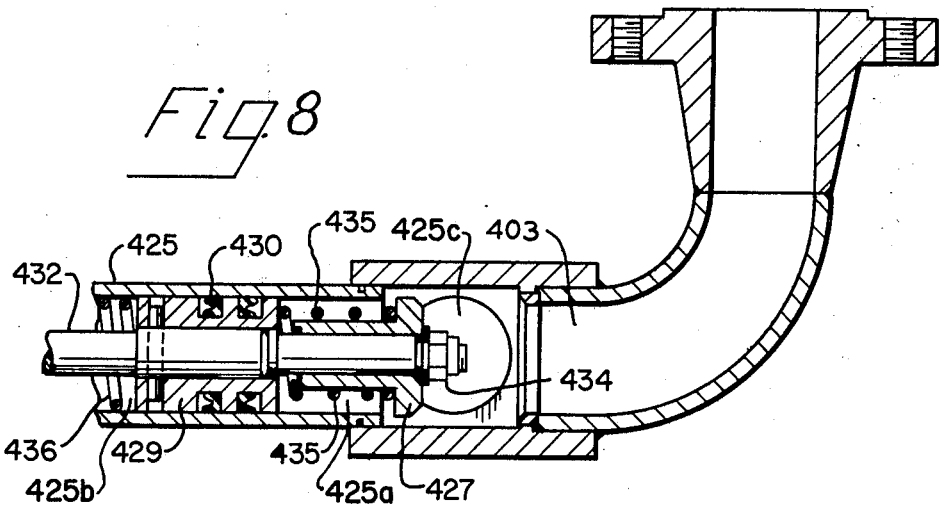

PUMP APPARATUS

REFERENCE TO RELATED APPLICATION

This application is a division of application Ser. No. 182,088 filed Sept. 20, 1971, now Pat. No. 3,835,617. which is incorporated herein by reference.

BACKGROUND OF THE INVENTION

This invention relates to an apparatus for disposition of radioactive waste materials, and more particularly to a metering pump for pumping radioactive material.

While the invention may be used for the packaging and disposition of various types of radioactive or chemically dangerous wastes, it can be exceptionally advantageously employed in the disposition of radioactive wastes as they occur in nuclear electric power generating stations.

Stringent laws, rules and regulations govern the disposition of radioactive wastes and their transportation over highways, on railroads and by other modes of transportation. In general, the material must be shielded so that radiations emanating from the material do not exceed maximum levels established by the laws and regulations. Furthermore, it is desired that in a case of an accident causing dumping of a radioactive load, there should be no fluidic materials that can penetrate the ground or mix with streams or ground water and cause radioactive contamination. It has therefore been proposed to provide a mixture of resin particles containing radioactive material, cement as a solidifying agent, and water in a container such as a steel drum, and to allow the mixture to solidify in the drum.

However, prior systems for putting radioactive materials into a drum or other container in general require that operators and maintenance personnel be exposed to radiation, even though such system may be intended to protect personnel. For example, the operators in many cases must go into areas containing radiation to open drums or close them or to insert nozzles in the drums or to handle the drums in storage. In some systems an operator may stand behind a shield wall, but must extend his arms into a radioactive zone, and expose his head to see, to connect pipes for feeding radioactive material. Maintenance men must go into radioactive areas to work on equipment requiring maintenance at intervals, such as conveying equipment, motors, and switches.

SUMMARY OF THE INVENTION

It is a general object of the present invention to overcome the above and other problems relating to the disposition of radioactive waste materials. A further object is the provision of apparatus and methods for overcoming as many as desired of the above indicated problems, as well as other problems. Another object is to provide apparatus and methods in which fluent materials containing radioactive or other dangerous materials can be placed and mixed in containers along with, if desired, solidifying agents such as concrete or asphalt or plastics. A further object is to provide apparatus for carrying out such operations by remote control so personnel need not be exposed to radiation during operations and to very little if any radiation during maintenance of equipment. A further object is provision of apparatus which can be easily repaired or maintained with little if any exposure of personnel or surrounding environment to hazardous radiation.

To accomplish these and other objects, the present invention provides apparatus for packaging fluent material such as dangerous or radioactive liquids, or slurries containing radioactive or otherwise dangerous particulate material without human handling or the necessity of personnel connecting pipes or the like including a metering pump means for introducing into a container in a preselected loading position an essentially predetermined amount of such fluent material in which preferably the proportion of liquid to radioactive or other dangerous material is accurately predetermined The metering pump has a main reciprocating pump piston and reciprocating inlet and outlet valves which are operated independently by remote control and can be used as either inlet or outlet valves. This permits back flushing of the decanting tank and flushing of clean water through various lines to clear blockages or clean the system. The pump and valves are provided with a body of liquid under pressure so that any leakage is toward rather than from the radioactive side.

The pump and the valves are mounted on one side of a demountable shield wall with actuating means on the other side of the wall and is constructed to facilitate repair or maintenance of the pump and the valves from the safe side of the wall. The pump and the shield wall are preferably adapted to be removed as a unit by an overhead crane.

BRIEF DESCRIPTION OF THE DRAWINGS

These and other objects and features of the invention will be apparent from the following description of a preferred embodiment of the invention in connection with the accompanying drawings in which:

FIG. 7 is an end elevation of the pump of FIG. 6;

FIG. 8 is an enlarged section of a portion of one of the valve mechanisms of the metering pump.

DISCLOSURE OF PREFERRED EMBODIMENT

General Arrangement

Figure 1:
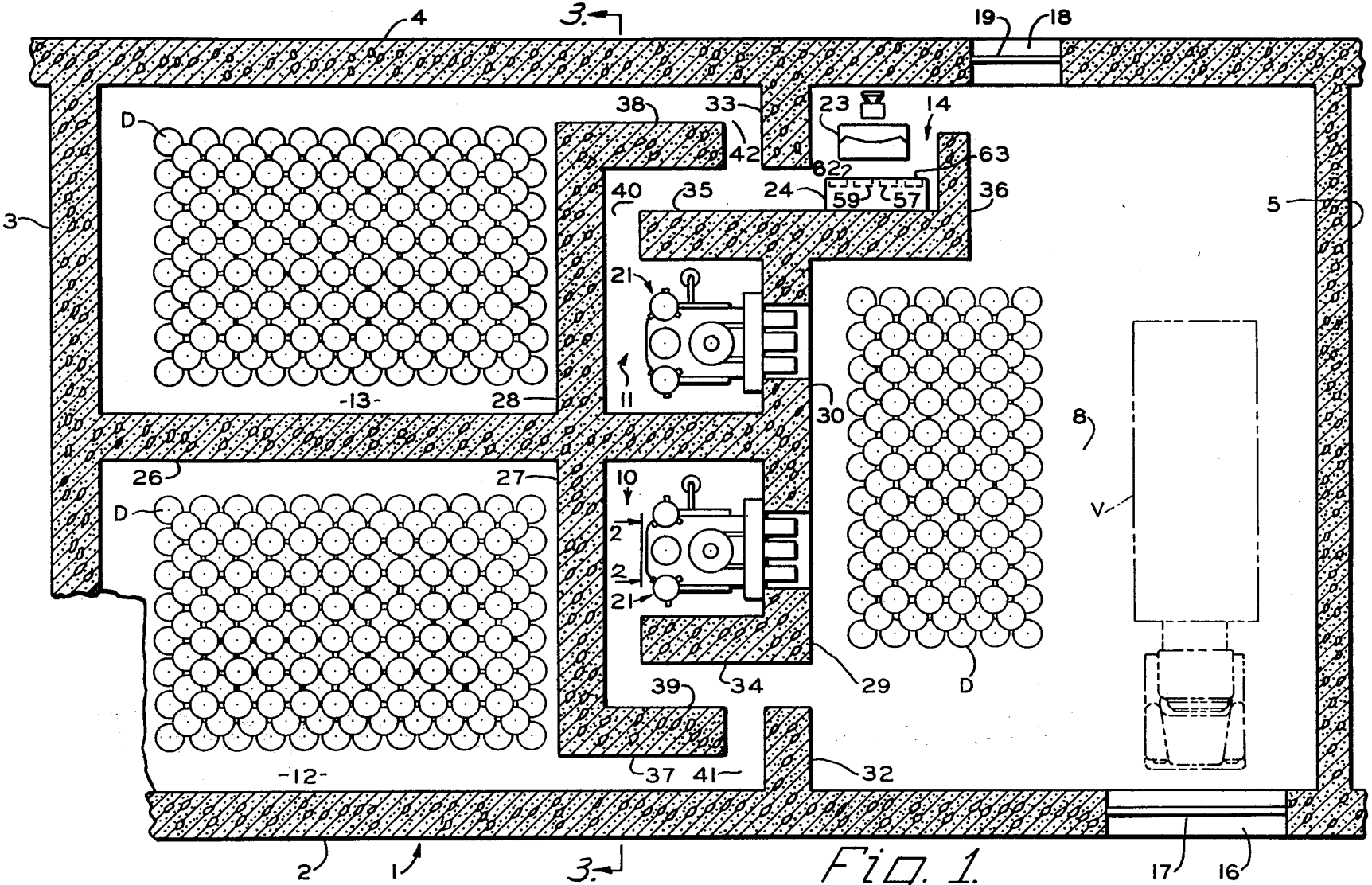
FIG. 1 is a plan section of a building and internal equipment for handling radioactive waste material, the scale being much smaller than full size.

For illustrative purposes, the below described embodiment of the invention will be described in connection with the disposition of radioactive waste material in the form of resin particles containing radioactive materials like those described above, and in the form of evaporator bottoms, by putting the radioactive material including water, and cement as a solidifying agent, into a steel drum; mixing these materials in the drum; moving the drum into storage; allowing the mixture to solidify and radioactivity to decay in storage; and then moving the drum to a vehicle for transportation.

For convenience, the term "drum" is used hereafter to designate steel drums or barrels as such, as well as suitable othe types of containers for the indicated purposes. While for convenience cement is disclosed as the solidifying agent and water as the liquid, it is to be understood that other suitable types of solidifying agents such as asphalt or certain natural or synthetic resins, and that suitable liquids other than water, may be used.

The reference numerals used herein and the terminology employed correspond to those used in said co-pending application Ser. No. 182,088, the entire disclosure of which is hereby incorporated by reference and made a part of the disclosure of the present application.

The equipment generally shown in FIG. 1 comprises a building 1 of rectangular configuration in plan, of which building upright walls 2, 3, 4 and 5, the ceiling and the floor are preferably formed of poured reinforced concrete, of sufficient thickness to prevent escape of harmful radiation from the interior of the building. The building interior is subdivided into an area 8, two drumming stations 10 and 11, two storage vaults or decay pits 12 and 13, and a control station 14.

The control station includes a control console 23 at which the operator will sit and from which he can control the operation of the apparatus by remote control. The control station also includes unit 24 spaced rearwardly from the control console and containing other apparatus and the television monitor screens 47, 59, 62 and 63.

Area 8, which is free of radioactive materials or radioactivity at all times except temporarily when radioactive materials are being shipped from the building, is shown as used for storage of non-radioactive materials such as drums D that contain no radioactive materials but may, and in this illustrative embodiment do, contain accurately weighed preloaded amounts of cement as a solidifying agent. The area 8 has in wall 2 a vehicle doorway 16 having a door 17. A personnel doorway 18 having a door 19, is in wall 4 near station 14.

Each drumming station 10 and 11 is equipped, as described below, with apparatus 21, operable by remote control from apparatus 23, 24 in operator control station 14, for introducing radioactive materials and water into drums D, each preloaded with accurately determined amounts of dry cement as a solidifying agent, all in proper proportions to permit these materials after thorough mixing to form in the drum a solid body of controlled weight, and for then thoroughly mixing these ingredients.

A drum D containing the resulting mixed radioactive material, cement and water may then be stored in a storage unit 12 or 13 to permit solidification of drum contents and decay of radiation until its intensity is reduced to shipable limits.

A drum D is picked up from area 8, put into a selected drumming station 10 or 11 then after proper filling and mixing moved if desired into a selected storage vault 12 or 13; and when desired moved onto vehicle V by remotely controlled overhead crane apparatus as disclosed in more detail in said co-pending application Serial No. 182,088.

These operations are performed by remote control without actual visual access, the operations being viewed through television screens and monitored by other means described below.

Building

The interior of the building 1 is subdivided into the storage vaults 12 and 13 by a thick center interior wall 25 and transverse end walls 27 and 28 that are joined to wall 26 and extend into relatively close proximity to but stop short of exterior side walls 2 and 4. Transverse walls 29 and 30 longitudinally spaced from interior walls 26 and 27, and stub walls 32 and 33 joined to outer side walls 2 and 3 and spaced from transverse wall 39 and 30 set off the area 8 and station 14 from the vaults and drumming station. Spaced transverse walls 27 and 29, and 28 and 30 together with a portion of center wall 26 and longitudinally extending intermediate stub walls 34 and 35 define the drumming stations 10 and 11.

An extension of wall 35 and a short transverse wall 36 joined to it define the operator station 14.

Walls 34 and 35 together with overlapping longitudinal wall portions 37 and 38 respectively fixed to transverse walls 27 and 38 and respectively spaced from walls 2 and 34 and from walls 4 and 35, together with the transverse walls 27 and 28 and walls 32 and 33, define labyrinthian passages 39, 40, 41 and 42 that prevent lateral escape of radiation from storage vaults 12 and 13 and the drumming stations 10 and 11 into area 8 and control station 14, while permitting access to the drumming station and vaults during contruction and later if necessary.

All of these walls are of sufficient thickness and formed of suitable material such as poured concrete, to prevent passage through the wall of harmful radioactive radiations.

The interior walls defining the control station, drumming stations, storage vaults and labyrinthian passages extend to locations below the ceiling of the building and are suitably shaped at their tops to permit clearance for an overhead crane apparatus so that it can move over and service the entire interior areas of building 1.

Drumming Station:

General Arrangement of Drumming Station

The apparatus in each drumming station comprises substantially the same four basic components; a metal shield wall 214, drumming equipment 215, a decanting tank 216 and a set of metering pumps 217*a, b, c.*

Shield Wall

The shield wall 214 serves as a locating and anchoring means for the other components 215, 216, 217*a, b, c.* It is formed of strong metal to support the other components and to serve as a barrier to stop the escape of harmful radiation from the side of the shield wall carrying these components, to the other side. The shield wall may be of any of various thicknesses, depending on the intensity of radiation expected to be encountered; since it is formed of metal its thickness is substantially less than conventional shielding such as concrete; moreover the faces of the shield wall may be machined, drilled and bored to present accurate surfaces for equipment mounting and uniform smooth surfaces for cleaning if required. Use of the metallic shield wall and its resulting lesser thickness simplifies drive connections and maintenance work done through the shield wall. A shield wall of steel approximately 12 inches thick is advantageous for most uses of the invention.

The shield wall is rigidly but demountably attached to the concrete building wall 29 or 30 by an accurately machined, grouted in frame 218 (FIGS. 3, 4) surrounding wall opening 219 to which the shield wall is secured by bolts and nuts 220 on the safe side of the shield wall. Preferably, the shield wall has a supporting eye 221 at its top. Therefore, the shield wall can be demounted with the other components still attached, and bodily removed as by an overhead crane to a remote location for maintenance or repair; the cantilever mounting of the components mounted on the shield wall, as described below, facilitates this; the cantilever supporting of components also eliminates floor supports and facilitates cleaning. The shield wall preferably overlaps the opening 219 to provide an offset joint that prevents possible radiation leakage around the shield wall edges.

Figure 3:
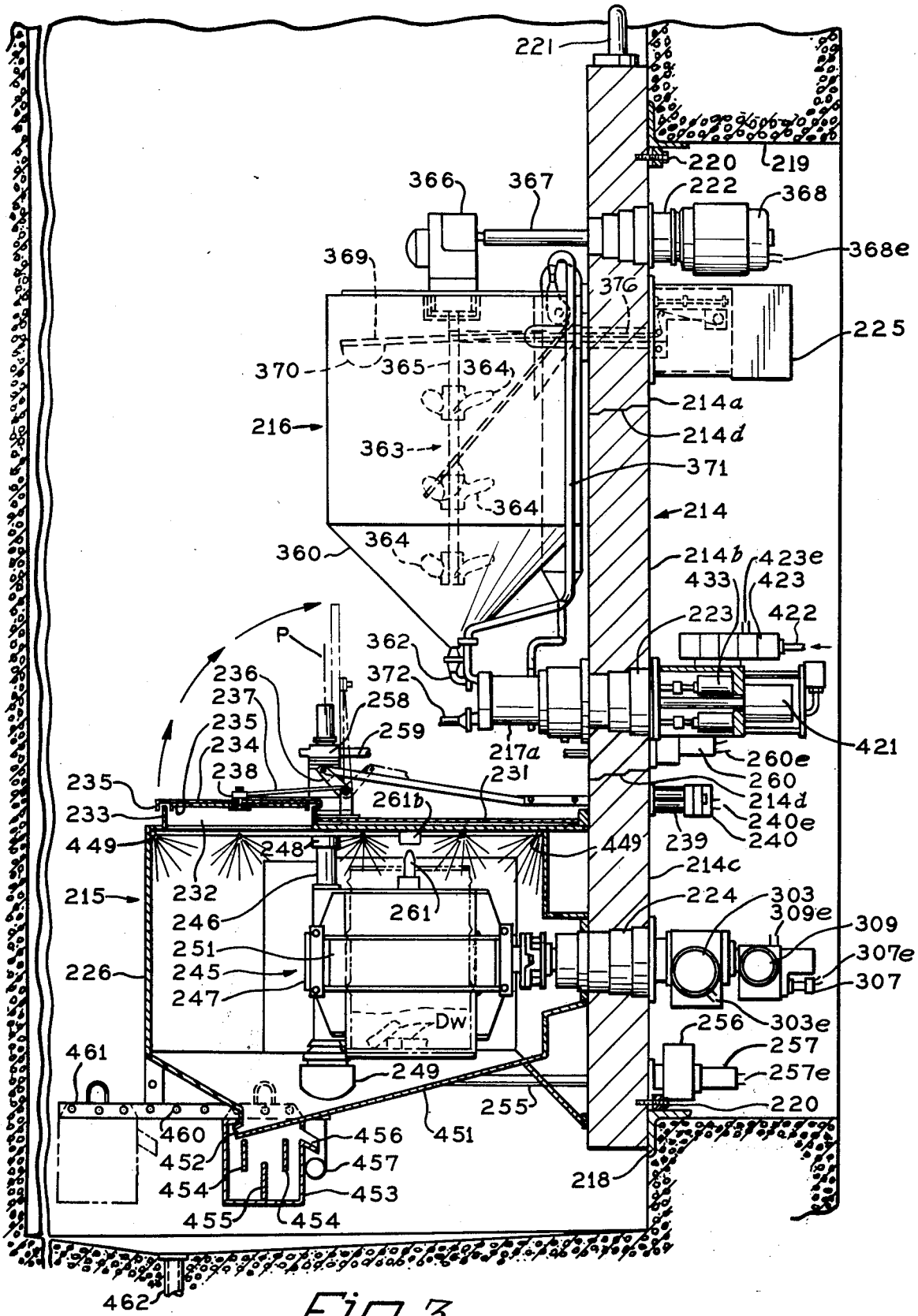
FIG. 3 is a side view of the drumming apparatus, parts being broken away to show the interior mechanism in the housing.
Figure 4:
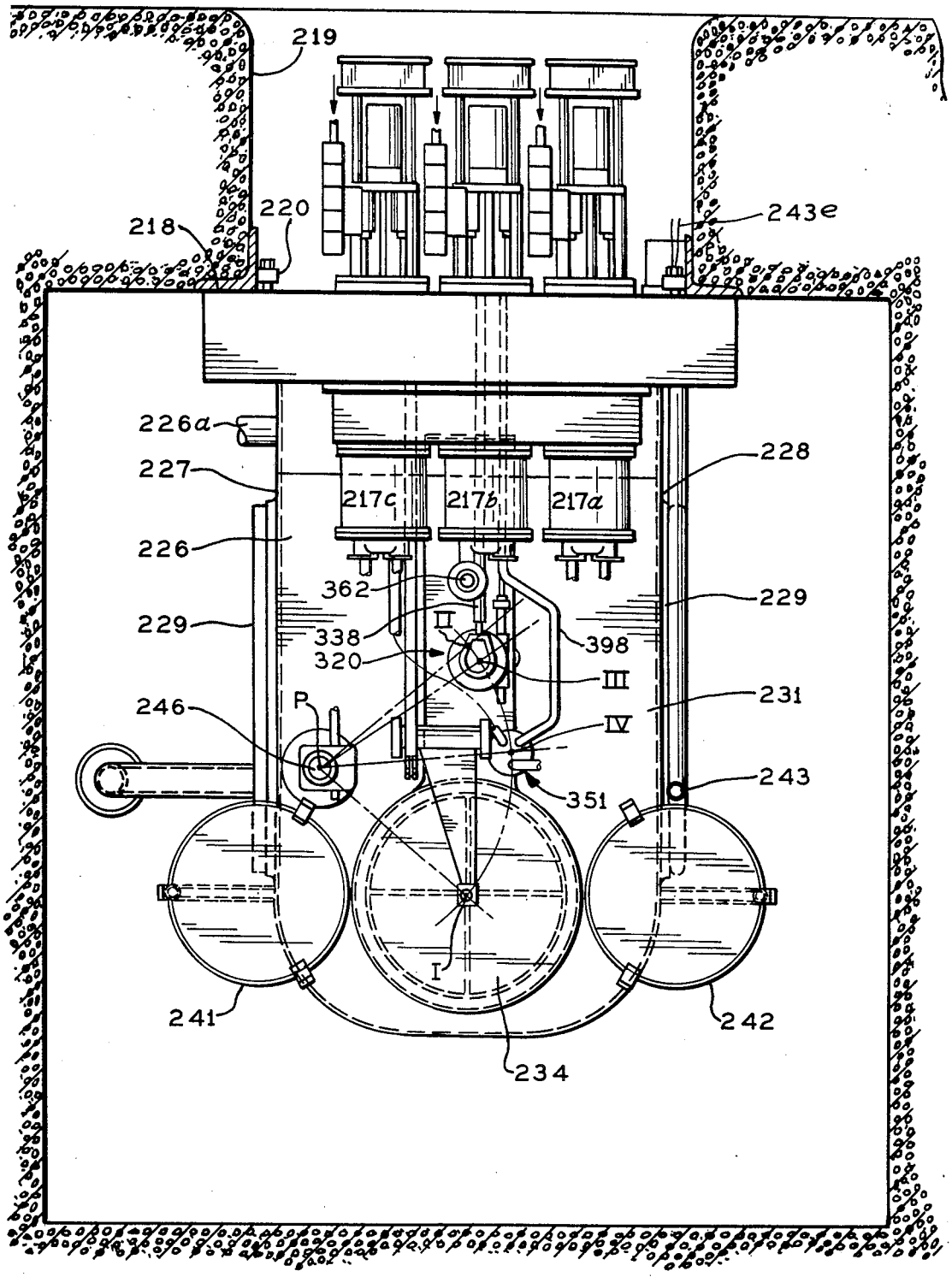
FIG. 4 is a plan view along line 4—4 of FIG. 2 and to a somewhat larger scale, parts being omitted for the sake of clearness.

The shield wall may be divided into sections 214*a*, 214*b*, 214*c*, by transverse joints 214*d* to facilitate easier handling and shipping. These joints are offset or stepped as shown in FIG. 3 to prevent radiation leakage outwardly to the safe side of the shield wall outside of the drumming station. As explained later, parts such as drives that pass through the shield wall are also sealed to removable plugs, as at 222, 223, 224 that form similar offset or stepped joints to prevent radiation leakage. Where space or design does not permit sealing to an offset or stepped plug, a secondary shield 225 is provided to block radiation escape.

Drumming Equipment

The drumming equipment 215 illustrated comprises a closed housing 226 supported from the side of the shield wall facing into the drumming station. This housing (FIGS. 2–5) has upstanding sides 227, 228 carrying detachably mounted access plates 229. The top 231 of the housing has a hatch opening 232 surrounded by upward flange 233, closed by a hinged hatch cover 234 having inner and outer downward flanges 235 that overlap flange 233 in the closed position to prevent escape of radioactive material. The housing and hatch cover when closed provide a closed enclosure in which drum loading and mixing occurs. The hatch cover permits access to the enclosure for introduction or removal of drums. Hatch cover 234 can be moved to closed and open positions by a lever 236 pivotally supported on housing 226 and is rigidly secured to an arm 237 carrying the hatch cover through a resilient connection 238. Lever 236 is actuated from the safe side of the shield wall by a known fluid-operated cylinder 239, the fluid valves 240 of which are controlled by known means 240*e* from the control station 14. Housing 226 has a venting conduit 226*a* preferably connected to a closed venting system.

A fixed loading dock 241 is externally mounted at one side of the housing 226 and is adapted to support a drum to be filled that is first deposited by the crane on this dock. A fixed unloading dock 242 is externally mounted on the other side of housing 226; a drum removed from housing 226 is set by the crane on this unloading dock, and the intensity of radiation emanating from the drum is measured by known radiation monitor means 243 that sends by known means 243e electrical signals to the control station 14 where information is noted. Each of the loading and unloading docks carries a scale 244 connected with known means for reporting the scale reading to the control station.

Inside of drumming equipment 215 is a drum positioner cradle mechanism 245 adapted to carry a drum and move it (FIG. 4) about a vertical axis P from a drum loading and unloading position "I", then to a first intermediate position "II" in which the drum is clamped into its cradle in a verticle position, then to a second intermediate position "III" in which the drum is opened by unscrewing and removing its cap, then to a third intermediate position "IV" where the drum is filled then back to intermediate position "III" in which the drum is closed or capped, then to intermediate position II where the drum is turned endover-end to agitate and mix its contents, from which position the cradle returns the drum to location I under the hatch from where the drum can be removed by grab 53. The cradle mechanism comprises a vertical shaft 246 (FIGS. 2-4) on which a cradle frame 247 is rigidly mounted; the shaft is rotatably and vertically slidably mounted in bearings 248, 249 mounted at the top and bottom of housing 226. A cradle 251 rotatably supported in the cradle frame by bearings for rotation about a horizontal axis H on its cradle frame which thus forms a trunnion in which the cradle can be rotated to impart to the drum the desired endover-end motion to thoroughly mix the contents of the drum, tumbling movement of the loose mixing weights Dw (FIGS. 3) in the drum adding this mixing.

The cradle frame 247 is moved to angular positions I, II, III, IV indicated above by actuating means (FIGS. 2, 3) comprising a lever arm 254 rigidly mounted on the lower end of shaft 246 and pivotally connected to a rod 255 that may be reciprocated as required by a known mechanism 256 driven from an electric motor 257 energization of which is controlled by known means 257e from control station 14.

The cradle frame 247, its supporting shaft 246 and cradle 251 carrying a drum can be raised and lowered as required to permit movement of the cradle and performance of necessary steps in the positions I–IV, by a known type of screw jack mechanism 258 (FIGS. 2, 3, 4) actuated by a drive shaft 259 extending through the shield wall to its safe side. Shaft 259 is rotated as required by a gear box electric motor combination 260, controlled by known means 260*e* from the control station to raise the cradle to an upper elevation referred hereafter as the U elevation in positions III and IV, and to lower the cradle to a lower elevation hereinafter referred to as the L elevation for movement between the positions and for operating in positions I and II.

When the cradle frame 247 is raised to elevation U in either of positions III or IV, an upwardly projecting tapered dowel pin 261 (FIGS. 3, 9) fixed to the top of the cradle frame engages in the opening 216*a* of the appropriate one of two hardened steel bushings 261*b* in the top wall 231 of the housing 226. This assures accurate and positive location of the cradle in positions III and IV for the filling and capping operations that are carried out in these positions.

Power means are provided for rotating the cradle when it is in position II-L including an electric motor 303 (FIG. 3) controlled by known means 303*e* from control station 14.

Axially movable means are provided for actuating the clamping arms including a double acting fluid operated power cylinder 307, and rotatable means are provided to clamp or unclamp the drum including an electric motor 309 (FIG. 3). The cylinder 307 and motor 309 are controlled by conventional means 307*e* and 309*e* from the station 14.

The drumming station also includes cap handling means 320 for removing and replacing a screw cap in the top of a drum.

After the cap has been removed at position III the drum is ready to have the radioactive material put in it. This is accomplished by locating the drum carrying cradle 251 in the filling position IV and lifting the cradle and drum to engage the opening 324 with the fill nozzle 351 (FIG. 4) in the top wall 231 of housing 226.

Decanting Tank

Decanting tank 216 (FIGS. 2, 3) is a closed tank formed of corrosion resistant durable metal, such as stainless steel, and is cantilever supported from shield wall 214. The tank has a frusto-conical lower portion 360 to aid in emptying material from the tank. A dispersion or slurry of radioactive resin particles in water is supplied to the tank from a suitable source such as a pipe 361 connected to a plant holding tank, by pump 217*b* connected to pipe 362 opening into the bottom of tank 216. The decanting tank has an internal mixer 363 for stirring the material in the tank when desired. That shown comprises three propellers 364 mounted on a common shaft 365 rotatable about a vertical axis aligned with the central axis of the tank. This shaft is rotated through a gearbox 366 by a drive shaft 367 extending through the shield wall from an electric drive motor 368 on the safe side of the shield wall. As desired the motor can be energized and controlled from control station 14 by conventional means 368*e*.

Tank 216 also has means for providing an adequate supply to the drumming station of a fixture of radioactive containing resin and water in a predetermined proportion. In general, the slurry supplied to the decanting tank contains excess water; and the decanting tank includes means fom removing excess water by decanting.

A dewatering or decanting pipe 369 is pivotally mounted in the tank at its inner end by a leakproof joint. The outer end of the pipe carries a float 370 so that the end of the pipe can rise and fall with the liquid level. A conduit 371 connects the inner end of pipe 369 to one of the metering pumps 217*a* the outlet of which is connected by pipe 372 through a fine strainer 373, such as 100 microns, to an outlet pipe system 374 forming part of a plant equipment drain system.

The levels of the water and of the radioactive resin particles in the decanting tank 216 are sensed by sensors 375, 376 (FIG. 3) that transmit electrical signals giving information as to levels to the control station 14. Both sensors are identical except for the specific gravities of their floats.

The operator at control station 14 can therefore determine, as from a predetermined curve or chart, the amount of water that should be left with the resin to provide the desired proportion of radioactive resin particles to the water. He can then actuate metering pump 217a to remove excess water through the floating end of decanting pipe 369, conduit 371, pump 217*a*, strainer 373 and conduit 374 until the desired level is reached, as indicated by the sensors 375, 376 to provide a dispersion in the tank of the desired predetermined proportion of water to resin particles.

After the proper proportion has been achieved, a proper amount of the dispersion can be caused to pass through conduit 362 from the bottom of tank 216 through metering pump 217b and conduit 398 to port 354*a* of filler nozzle 351 into a drum D (FIGS. 31, 32, 40).

Preferably, spray heads 399 (FIG. 2) are provided inside of the decanting tank to spray clear water to cleanse the floats 383*a* and 383*b* when they are lifted to their highest elevations; their valves can be controlled by suitable means, as from proximity switches 394.

Metering Pump

Figure 6:
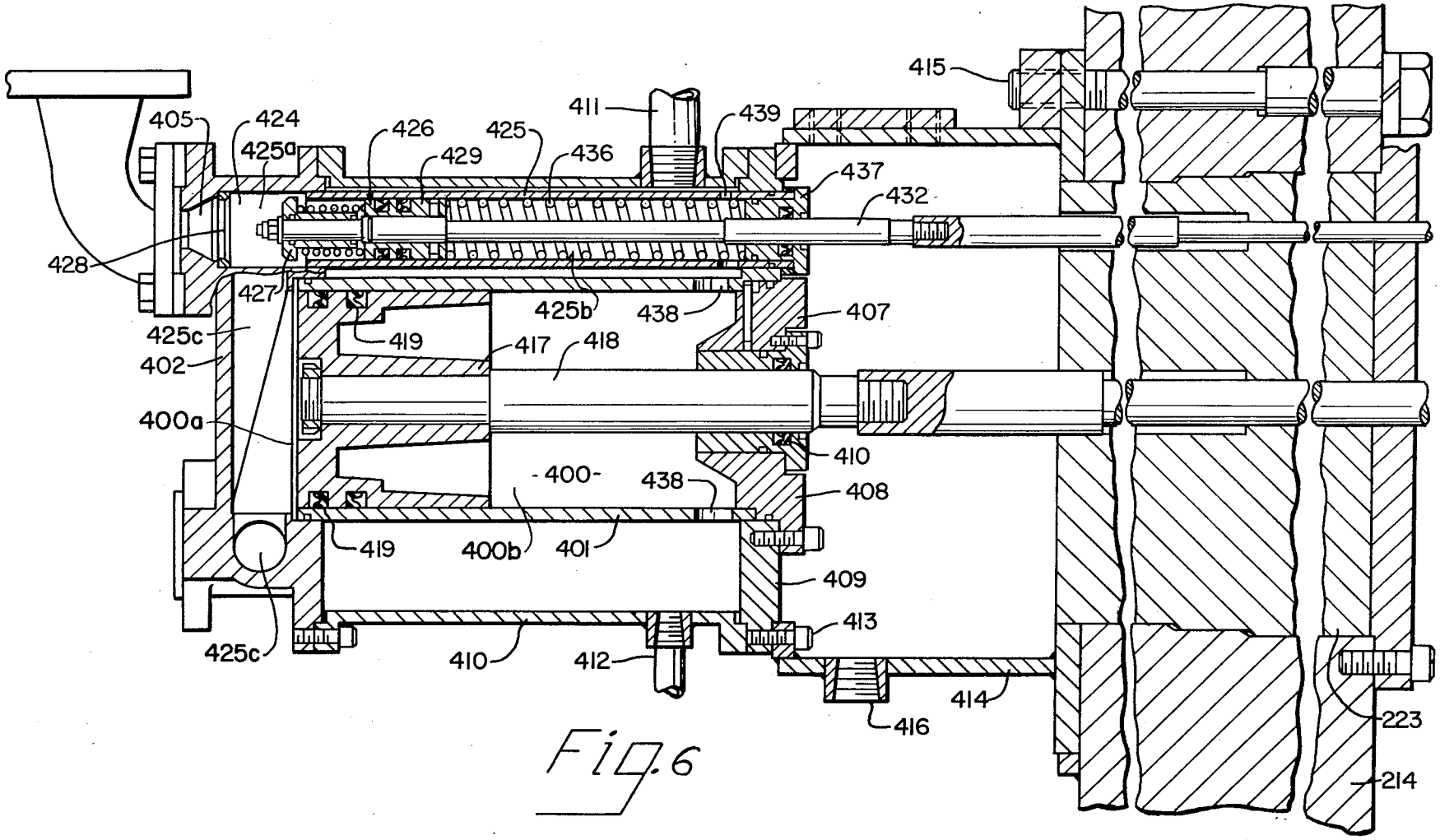
FIG. 6 is an enlarged vertical section of one of the metering pumps of the invention, along line 6—6 of FIG. 7.

While a pump of any various types may be employed to pump the dispersion of radiactive particles in water from athe decanting tank 216 through filler nozzle 351 unto the drum D, the pump illustrated in FIGS. 6–8 is exceptionally advantageous. It delivers accurately measured quantities of liquid and thus makes possible accurate remote control of the amount of liquid passed from the decanting tank into the drum. It also makes possible the pumping of clean water for disrupting sedimentation of the particles in the tank or conduits, the use of clean water for sealing purposes, and has safety features in making possible maintenance of the pump from the safe side of the shield wall 214.

The illustrated pump 217b shown in the above Figures comprises a cylinder 400 made up of cylinder barrel 401, head 402 containing inlet ports 403 and 404 and outlet ports 405, 406 and another head 407 made up of internal member 408 and that closes the end of the cylinder and a surrounding member 409 that contains portions of valve actuating mechansim. The heads are secured to the ends of barrel 401 by being bolted to the ends of a flanged cylinder 410 that surrounds barrel 401 and has inlet and outlet conduits 411 and 412 for clear water flow.

The pump is mounted as by bolts 413 on a mounting bracket 414 that it itself mounted by through bolts 415 on the shield wall 214. Bracket 414 has a drain opening 416 for escape of leakage if it might occur.

The pump also comprises a piston 417 fixed to piston rod 418 that extends through head 407 and shield wall 214. The piston has sealing rings 419 and rod 418 sealed by means 420 in head 407. The piston rod is reciprocated as required by an air cylinder 421 (FIG. 3) supplied with air from pipe 422 connected to suitable source and controlled by an air valve system 423. The valve is controlled by suitable known means 423*e* from the control station 14 so that it can cause a predetermined number of strokes of the pump, and hence the pumping of a predetermined amount of slurry of radioactive waste particles and water into the drum D.

Valve 424 for port 405 comprises a cylinder barrel 425 that is rigidly connected and sealed to heads 402 and 407, and a movable member 426 including a closure member 427 adapted to bear against a valve seat 428 in head 402. Movable membe 426 also includes piston 429 carrying sealing rings 430 that seal against escape of liquid being pumped from the space or chamber 425*a* on the side at which closure member 427 is located to the space on the other or rod side of piston 429. Space 425*a* communicates through passage 425*c* with the space or chamber 400*a* on the side of pump piston 417 through which passes the liquid being pumped. Movable member 426 is actuated by a valve rod 432 actuated by an air cylinder 433 on the safe side of the shield wall and supplied with air from source 422 under control of suitable valves in system 423 remotely controlled from control station 14 by known electrical means 423e.

Valve rod 432 is connected to clusre member 427 by a loose connection (FIG. 8) comprising a stop nut 434 on the end of the rod and a compression spring 435 operating between closure member 427 and piston 429. Another compression spring 436 operating between piston 429 and a head 437 at the inner end of valve barrel 425 urges movable member 426 toward the position where its closure member 427 contacts valve seat 428 in sealing engagement, except when the valve is opened by air cylinder 433.

The air cylinder 433 positively opens the valve by pulling closure member 427 away from its seat 428. The valve is impositively closed by the force of the spring 436 as the rod moves in the other direction; the present force of spring 435 also insures that closure member 427 will not strike seat 428 with excessive force, thereby eliminating possibilities of chipping or spalling of the valve seat or the closure member and thus reducing maintenance problems.

All valves are similar in construction and operation. Each is operable independently of the piston 417, and each can be operated as an outlet or as an inlet valve, depending on how it is operated relative to the piston operation.

Conduit 411 provides clean water from a suitable source such as an elevated tank or a pressurized tank, to the space between the outer housing 410 and the cylinder barrel 401 of the pump and the valve barrels. 425; and through ports 438 to the space or chamber 400b on the rod side of piston 417 in cylinder 400, and through ports 439 to the space or chamber 425b on the rod side of the piston 429 of each valve.

In the illustrated embodiment (FIGS. 2, 9) this clean water is supplied to such spaces in all pumps 217*a*, 217*b*, 217*c* from an elevated tank 440 through an expansion tank 441 and conduit 411. Therefore, as is preferable, the clean water in these spaces at all times is at a pressure higher than the mixture of water and radioactive particles at the piston sides of the pump and its valves. Consequently, any leakage that may occur past a piston packing in the pump or a valve will be leakage of clean water into the portion of the apparatus containing the radioactive materials, and not the reverse. Consequently there is much less opportunity for the parts including sealing rings, to pick up radioactive material and thereby make the entire assembly radioactive. This is another feature that greatly reduces maintenance problems.

Preferably, the piping may be arranged so that one valve of each pump is connected to a clean water source such as line 450, and the valves are operable either as inlet or outlet valves, so that clean water may be pumped from the source by each pump. Thus pump 217b can be used to pump clean water when desired back through conduit 362 into the decanting tank. This is advantageous since such back flushing can break up any mass of resin particles that may tend to settle in the decanting tank to form a cake that is difficult to start with the agitator 363. Any settling of resin particles that tends to occur, between drum fillings, in conduit 362 can also be readily disrupted to prevent clogging by pumping a small amount of liquid such s clean water back through conduit 362 by the pump. Such back pumping of clean water can also provide additional liquid for agitation in tank 216.

All of the piston and valve rods for each pump 218 pass through a stepped plug 223 that fits into a corresponding opening in the shield wall, the steps providing a labyrinthian joint between the shield wall and plug that prevents passage of radiation or radioactive materials. This plug can be removed from the safe side of the shield wall.

The design is such that after the piston and valve rods are disconnected from their air cylinders and plug 223 is removed, it is possible to remove head 408 that closes the end of pump cylinder 400 and members 437 that close the ends of the valve barrels. This permits removal of the piston or movable valve portions for maintenance, as for examination, lubrication, replacement of packings, from the safe side of shield wall 214 without removing the pump as a whole. If there should be any radioactivity in these parts, then be means of long handled wrenches and mirrors a maintenance man can inspect or take corrective action without exposing himself to radiation.

Figure 2:
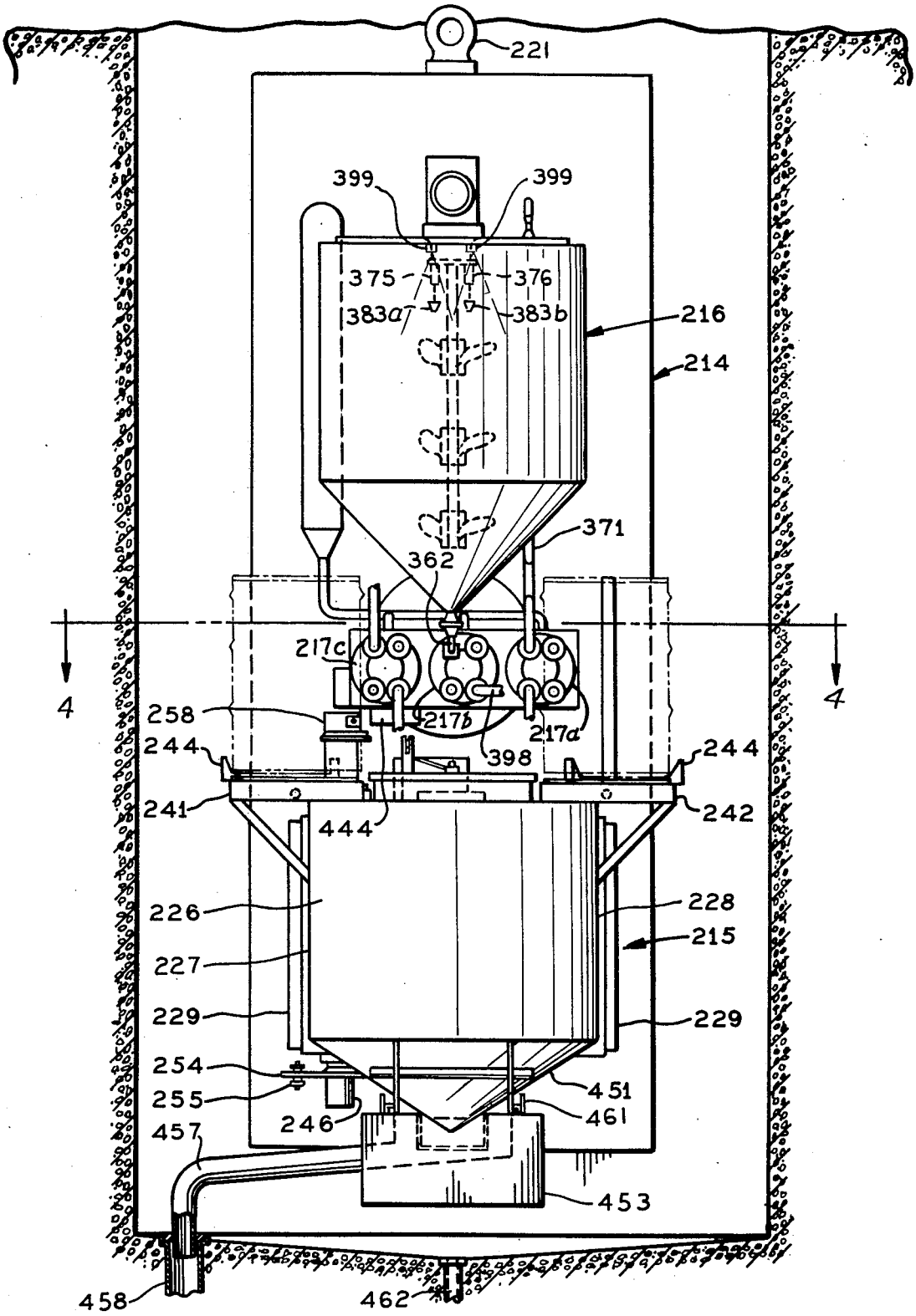
FIG. 2 is a view of drumming apparatus in the drumming station, from line 2—2 of FIG. 1 and to a scale considerably larger than that of FIG. 1.

Bracket 414 as indicated has opening 416 through which any liquid leaking from the pump apparatus into the housing will drip out into a small tank 444 (FIG. 2). If the operator finds liquid in this tank he will know that there is a packing leak somewhere and take corrective action. The small tank can be drained into the overall drain system.

Pump 217*c* may be identical to that described above. This pump is adapted to accept liquid carrying evaporator bottoms (FIG. 9) from a suitable source, such as conduit 445 connected to a holding tank not shown and discharge through conduit 446 a measured quantity of such liquid through fill nozzle 351 into a drum in the drumming station.

Chemicals in the evaporator bottoms may have a tendency to crystallize out of solution, and if so it is preferable that the pump 217*c* together with its valve and the piping associated therewith be provided with heating means, such as wound heating elements, to prevent crystallization at lower temperatures.

Pump 217*c* also is adapted to flush clean water through the pump back through the evaporator bottoms line in order to clean the pump and line at the end of a drumming session.

Pump 217*a* which removes excess water from the decanting tank may, if desired, be identical with pump 217*b* and filled with clean sealing water in the same manner as that described above, although it is not necessary that it be a measuring pump. Preferably the excess water removed from the decanting tank by this pump passes eventually to the nuclear plant system that supplies evaporator bottoms to the drumming station.

By suitable operation of the proper pumps 217*a, b, c*, clean water can also be flushed through other lines to clear blockages or clean the system, such as the lines that discharge into the drum; clean water can also be added, as to the decanting tank if desired. This is facilitated because all valves of each pump are identical and independently operable so each can be used as an inlet or outlet valve, and the piston is operable independently of the valves; these capabilities provide features of safety and redundancy for maintennance of operations.

In each of the illustrated drumming stations, two types of radioactive waste products, slurries of radioactive resin particles and liquids containing evaporator bottoms, may be alternately put into drums, or if desired, both may be put into a single drum in proportional quantities. If desired, the system can be modified to handle more than two waste materials alternately or put all simultaneously in a drum.

Drumming Station Cleaning System

Figure 5:
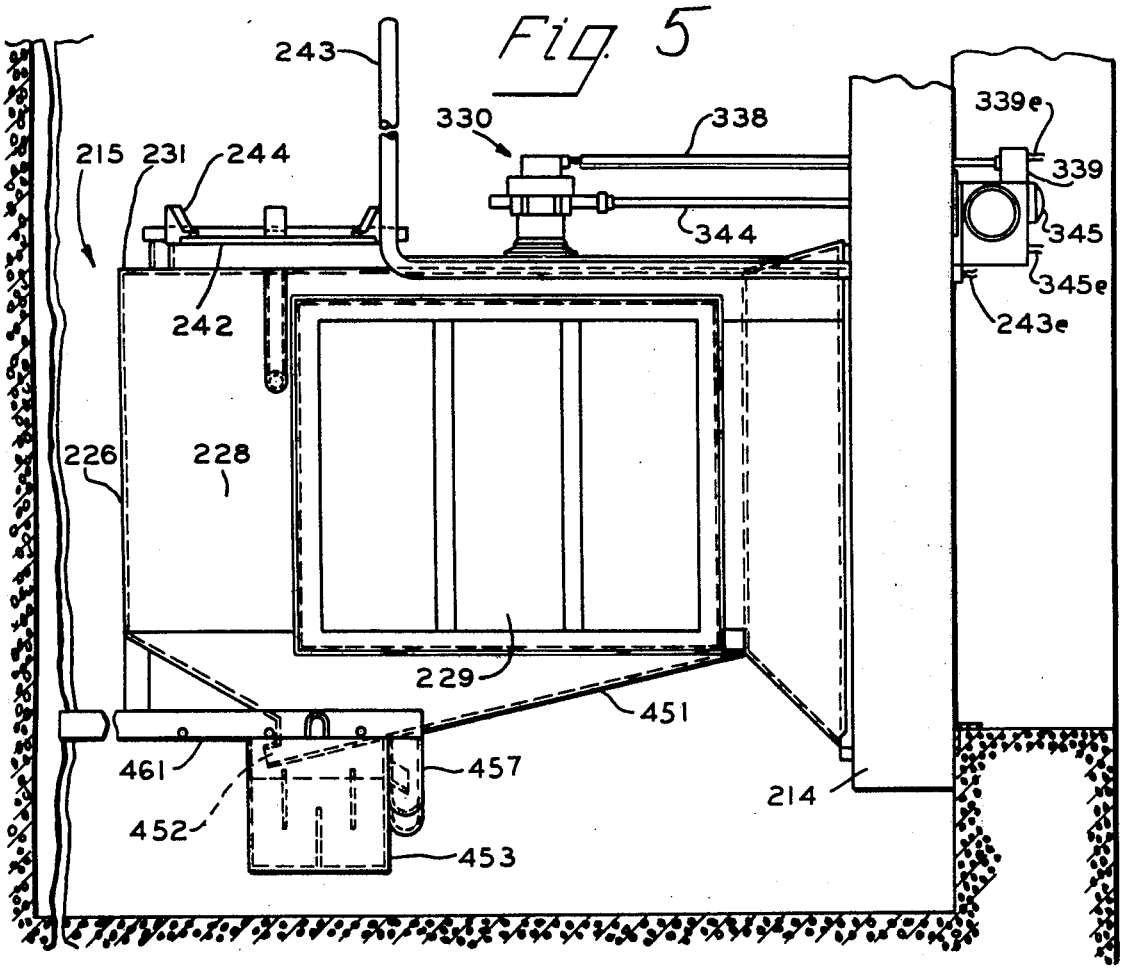
FIG. 5 is a side elevation of the lower portion of the drumming apparatus, in general corresponding to the side elevation of FIG. 4.

Spray heads 449 (FIG. 3) connected to clean water source 440 and controlled from station 14, are provided inside of drumming equipment enclosure 226 to wash down the walls and equipment in the enclosure if desired. The spray water used flushes down the sloped bottom 451 of enclosure 226 and drains out through a bottom opening 452 into a sump tank 453 (FIGS. 2, 3, 5). This sump tank has internal baffles 454, 455 to provide a settling tank for fines that might be in the flush water. Excess water free of fines flows out through an overflow gate 456 into a drainage spout 457 discharging into a drain 458 located in the drumming station floor and connected to plant equipment drain system 459. The sump tank is so designed that it can be moved laterally of rollers 460 on a track 461 to a location where it can be removed by the crane.

Another drain in each drumming station floor forms part of a plant floor drain system 462.

Figure 9:
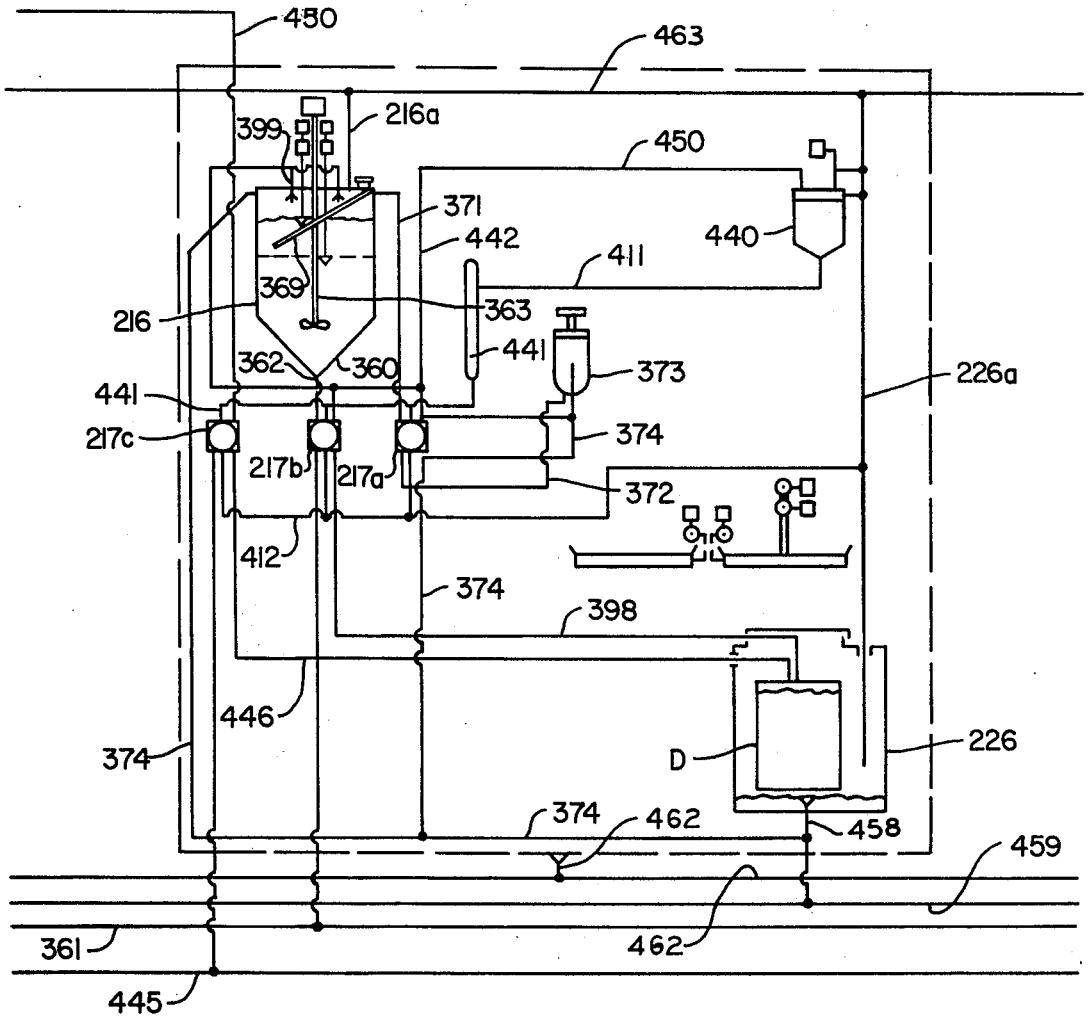
FIG. 9 is a schematic piping diagram for a drumming station.

The conduit system of FIG. 9 is shown for a single drumming station, but it can be duplicated. In such case lines 361, 445, 450, 459, 462 and 463 as well as other lines, can be common to two or more drumming stations.

As disclosed above, the illustrative embodiment has separate piping for each type of radioactive waste to and in the drumming station equipment, for safety and continuity of operation. The drumming apparatus 215 is completely enclosed and sealed to allow no escape of liquids, solids or gasses except through conduits planned and provided for such purposes. Thus, a vent system 463 removes and cleanses by known means, air or gases from decanting tank 216 through vent conduit 216*a*, and from drumming housing 226 through vent conduit 226*a*, as well as from other locations. The interior of housing 226, and the equipment in it, can be washed down by remotely controlled spray heads 449 for decontamination purposes if necessary.

As disclosed, two separate and independent means are used to determine the amount of material in the drum and to prevent overfill; one means comprises metering pumps that pump accurately determined amounts of fluids into the drums; the other means comprises the liquid level sensing system indicated.

The term "evaporator bottoms" is intended to include concentrated liquid wastes from a nuclear power plant, such as solutions containing boric acid, borax, sodium sulphate and the like, which may contain radioactive impurities.

The term "fluent material" is intended to cover slurries or dispersions of particulate materials in liquids; liquids not containing particulate materials; and other flowable materials that may be handled according to the apparatus and process of the invention. The particulate materials may be of sizes different from those indicated above, as substantially larger.

While the container has been disclosed as a steel drum, it is apparent that other types of containers may be used.

It will be understood that modifications may be made in the apparatus disclosed, and other modifications, advantages, and modes of operation will become apparent without departing from the spirit of the invention.

Having described our invention, we claim:

1. Pump apparatus adapted to pump fluid comprising a shield wall, a housing mounted on said wall, a pump cylinder in said housing, a pump piston mounted to reciprocate in said cylinder means for reciprocating said piston including a piston rod extending through said shield wall, said cylinder and said housing providing at a side of said piston a first chamber of variable volume into which fluid being pumped is introduced, said first chamber having inlet and outlet openings and valve means at said chamber or opening and closing said openings, and also having a removeable pump closure member closing the end of said pump cylinder remote from said first chamber to provide a second chamber at the side of said pump piston opposite that at which said first chamber is located, means for supplying liquid other than the fluid being pumped to said second chamber at a pressure sufficient to prevent leakage from said first chamber of fluid being pumped, valve means at said inlet and outlet openings of said first chamber for opening and closing said openings, means for moving said valve means independently of each other and of said piston to open and close said openings independently of each other and of said piston comprising a valve actuating rod actuatable independently of said piston rod and extending through said shield wall, demountable shield portion means demountably fixed to said shield wall through which demountable shield portion means said pump piston rod and the actuating rod of said valve means extend and which can be removed to permit removal from said pump cylinder of said removable closure member and said piston.

2. The pump apparatus of claim 1 in which the actuating rod of said valve means is mounted to reciprocate in a valve cylinder adjacent said pump cylinder and having a valve closure member which can be removed to permit removal of the associated valve means.

3. Pump apparatus adapted to pump fluid comprising a pump cylinder; a pump piston slidably mounted in said cylinder to define with said cylinder a pumping chamber into and from which fluid being pumped passes; a pump piston actuating rod for reciprocating said piston in said cylinder; means providing openings, with valve seats, into said pumping cylinder through which fluid to be pumped may pass; a valve closure member associated with each of said openings and adapted by contacting the valve seat of the opening associated with said closure member to close said opening and by movement away from said seat to open said opening; a valve actuating rod for moving each of said valve closure members so as to open and close the opening with which it is associated; and means for moving each of said valve actuating rods axially thereof independently of any other valve actuating rod and of said pump piston actuating rod so as to permit any one of said valve closure members to open or close its associated opening to permit introduction of or discharge of fluid from said pumping chamber, so that each of said valve closure members may be moved to permit fluid to be introduced into said pumping chamber while each other valve closure member may be moved to act to prevent discharge of fluid from said pumping chamber, or to permit discharge of fluid from said pumping chamber while each other valve closure member may be moved to prevent discharge of fluid from said pumping chamber, or to be moved in cooperation with another valve closure member to open a plurality of said openings into said pumping chamber so that fluid may pass freely through said pumping chamber to flush it.

4. The apparatus of claim 3 in which all of said valve actuating rods and said piston actuating rod extend generally parallel and in the same direction.

5. The apparatus of claim 3 in which said means for actuating said valve actuating and piston actuating rods are adapted to be actuated from one side of a shield wall on the other side of which said pump cylinder and said valve closure members are mounted.

6. Pump apparatus adapted to pump fluid comprising a shield wall, a housing mounted on said wall, a pump cylinder in said housing, a pump piston mounted to reciprocate in said cylinder, means for reciprocating said piston including a piston rod extending through said shield wall, said cylinder and said housing providing at a side of said piston a first chamber of variable volume into which fluid being pumped is introduced, said first chamber having inlet and outlet openings and valve means at said chamber for opening and closing said openings, and also having a removable pump closure member closing the end of said pump cylinder remote from said first chamber to provide a second chamber at the side of said pump piston opposite that at which said first chamber is located, means for supplying liquid other than the fluid being pumped to said second chamber at a pressure sufficient to prevent leakage from said first chamber of fluid being pumped, valve means at said inlet and outlet openings of said first chamber for opening and closing said openings, means for moving said valve means independently of said piston to open and close said openings comprising a valve actuating rod actuatable independently of said piston rod and extending through said shield wall, demountable shield portion means demountably fixed to said shield wall through which demountable shield portions means said pump piston rod and the actuating rod of said valve means extend and which can be removed to permit removal from said pump cylinder of said removable closure member and said piston, a valve cylinder adjacent said pump cylinder, said actuating rod being mounted to reciprocate in said valve cylinder, said valve cylinder having a valve closure member which can be removed to permit removal of the associated valve means, said valve closure member providing in said valve cylinder a chamber for receiving liquid under pressure sufficient to prevent leakage around said valve actuating rod, said last-named chamber being in communication with said second chamber of said pump cylinder.

7. Pump apparatus adapted to pump fluid comprising a housing, reciprocable pumping means in said housing that provides on one side of said pumping means a chamber of variable volume into which fluid being pumped is introduced by a suction stroke of said pumping means and from which said fluid is expelled on a pumping stroke of said pumping means; means providing two passages opening into said chamber of variable volume; two actuatable valve means each adapted independently of the other to open and close one of said passages so said valve means can act as inlet valve means permitting passage of fluid into said chamber on a suction stroke of said pumping means or as outlet valve means permitting passage of fluid out of said chamber on a pumping stroke of said pumping means; means for reciprocating said pumping means in pumping and suction strokes; and means; operable independently of said means for reciprocating said pumping means, for actuating each of said valve means independently of said means for reciprocating said pumping means and independently of the other valve means so that either of said valve means can act as inlet valve means or as outlet valve means, each of said actuatable valve means comprising a valve seat, a reciprocable valve member, a valve closure member movably mounted on and adapted to be moved by said reciprocable valve member in a path between the valve open position and a valve closed position in which said closure member contacts said valve seat, and shock absorbing means operating between said reciprocable valve member and said valve closure member to reduce impact force on said valve closure member when it moves to valve closed position and engages said valve seat.

8. Pump apparatus adapted to pump fluid comprising housing means; a pump cylinder in said housing means; a pump piston slidably mounted in said cylinder to define with said cylinder a pumping chamber into and from which fluid being pumped passes; an actuating rod for reciprocating said piston in said cylinder; openings in said housing means into said pump cylinder through which fluid being pumped may pass, said openings having valve seats; a valve closure member associated with each of said openings and adapted by contacting the valve seat of the opening associated with said valve closure member to close said opening and by movement away from said seat to open said opening; valve actuating rod means slidably mounted in said housing means for moving each of said valve closure members so as to open and close the opening with which said valve closure member is associated; means for moving each of said valve actuating rod means axially thereof independently of any other valve actuating rod means and of said pump piston actuating rod so as to permit any one of said valve closure members to open or close its associated opening to permit introduction of or discharge of fluid from said pumping chamber; means supplying liquid other than the fluid being pumped to contact said piston and said cylinder at a location away from said pumping chamber, and to contact each valve actuating rod means and said housing means at a location away from said openings, said liquid being supplied at a pressure higher than the maximum pressure of said fluid being pumped so that any leakage between said piston and said cylinder or between said valve actuating rod means and said housing means will be leakage of said other liquid and not leakage of said fluid being pumped; and a source of liquid other than the fluid being pumped that is connected through said openings into said pump cylinder, said valve closure members being adapted to be actuated be said valve actuating rod means to cause pumping of said fluid being pumped in one direction and also to cause pumping of said liquid other than the fluid being pumped in the opposite direction to effect flushing.

9. Pump apparatus adapted to pump fluid, comprising a shield wall; a housing mounted on said wall; a pump cylinder in said housing; a pump piston in said cylinder that provides on one side of said pump piston a chamber of variable volume into which fluid being pumped is introduced by a suction stroke of said piston and from which said fluid is expelled on a pumping stroke of said piston; an actuating rod for reciprocating said pump piston in said pumping and suction strokes; means for actuating said pump piston actuating rod; means providing two passages opening into said chamber of variable volume; two actuatable valves means, each comprising a reciprocable valve closure member and a valve actuating rod for reciprocably moving said valve closure member independently of the other valve closure member and of the piston to open and close one of said passages so that each of said valve means can act as an inlet valve means permitting passage of fluid into said chamber on the suction stroke of said piston or as outlet valve means permitting passage of fluid out of said chamber on a pumping stroke of said piston; a n d means, operable independently of said means for actuating said pump piston actuating rod, for actuating each of said valve closure member actuating rods independently of said means for actuating said pump piston actuating rod and independently of the other valve closure member actuating rod so that either of said valve means can act as inlet valve means or as outlet valve means, and in which apparatus said valve closure member actuating rods and said pump piston actuating rod are generally parallel and extend toward the same end of said pump apparatus adjacent which are located said means for actuating said valve closure member actuating rod and said means for actuating said pump piston actuating rod, and in which apparatus said pump cylinder including said pump piston and said valve means including said valve closure members are located on one side of said shield wall, and said means for actuating said pump piston actuating rod is located on the other side of said shield wall, and said pump piston actuating rod extends through said shield wall.

10. Pump apparatus adapted to pump fluid comprising a housing, reciprocable pumping means in said housing that provides on one side of said pumping means a chamber of variable volume into which said fluid being pumped is introduced by a suction stroke of said pumping means and from which said fluid is expelled on a pumping stroke of said pumping means; means providing at least three passages opening into said chamber of variable volume; at least three actuatable valve means, each adapted independently of the other two valve means and of the pumping means to open and close one of said passages so that each of said valve means can act as inlet valve means permitting passage of fluid into said chamber on a suction stroke of said pumping means or as outlet valve means permitting passage of fluid out of said chamber on a pumping stroke of said pumping means; means for reciprocating said pumping means in pumping and suction strokes; and means, operable independently of said means for reciprocating said pumping means, for actuating each of said valve means independently of said means for reciprocating said pumping means and independently of the other valve means so that any of said valve means can act as inlet valve means or as outlet valve means.

* * * * *